US005734136A

United States Patent [19]

Newcomer et al.

[11] Patent Number: 5,734,136

[45] Date of Patent: Mar. 31, 1998

[54] KEYPAD ASSEMBLY WITH MOISTURE-EXCLUDING SEAL

[75] Inventors: Kimberly R. Newcomer, Ramona; Daniel H. Weber, San Diego, both of Calif.

[73] Assignee: Qualcomm Incorporated, San Diego, Calif.

[21] Appl. No.: 662,163

[22] Filed: Jun. 12, 1996

[51] Int. Cl.[6] ..... H01H 9/26; H01H 9/04

[52] U.S. Cl. ..... 200/5 A; 200/302.1

[58] Field of Search ..... 200/5 A, 302.1, 200/302.2, 302.3, 329, 341; 277/209, 210

[56] References Cited

U.S. PATENT DOCUMENTS

| | | | |
|---|---|---|---|
| 4,980,522 | 12/1990 | Murakami et al. | 200/5 |
| 5,172,805 | 12/1992 | Gunb | 200/341 |
| 5,502,162 | 3/1996 | Wong | 528/498 |
| 5,531,460 | 7/1996 | Stefansson | 277/206 R |

*Primary Examiner*—Michael L. Gellner
*Assistant Examiner*—Michael J. Hayes
*Attorney, Agent, or Firm*—Russell B. Miller; Gregory D. Ogrod

[57] ABSTRACT

A keyboard or keypad assembly has an outer housing of rigid material with an upper panel having a single opening or plural key receiving openings, and a keypad of resilient material located beneath the upper panel, with keys projecting upwardly from the keypad through the panel. A printed circuit board is positioned in the housing beneath the keypad and is secured to the upper panel with the keypad sandwiched between the panel and circuit board. The keypad has a peripheral rim surrounding the key containing area, and an upwardly facing groove is located in the rim. A corresponding, downwardly projecting rib is provided on the upper panel for seating in the groove to form a moisture seal by compressing the resilient material at the base of the groove, so that spilled liquids cannot enter the area in which the circuit board is located via the openings in the upper panel.

3 Claims, 2 Drawing Sheets

KEYPAD ASSEMBLY WITH MOISTURE-EXCLUDING SEAL

BACKGROUND OF THE INVENTION

The present invention relates generally to keypads or keyboards of the type incorporated into computer terminals, calculators and the like for operator input of commands and data.

A computer terminal typically has a keypad or keyboard unit having an outer housing in which a printed circuit board is mounted. Switches on the printed circuit board are actuated by operator depression of keys which project through an opening in the housing and carry contacts for actuating the switches. One problem with such keyboards or keypad units is that moisture can enter the unit through the keypad openings, and potentially damage the circuit or system. Up to now, no effective technique for sealing the interior of the keyboard unit against moisture has been devised.

SUMMARY OF THE INVENTION

It is an object of the present invention to provide a new and improved keypad assembly.

According to the present invention, a keypad assembly is provided which comprises an outer housing having an upper control panel and a downwardly depending rim defining an internal area, the control panel having a keypad area having plurality of key openings, an integral, one-piece keypad member of resilient material located in the internal area beneath the keypad area of the upper control panel, the keypad member having a plurality of keys each aligned with a respective one of the key openings and extending upwardly through the aligned opening, and a peripheral rim area surrounding the keypad area, a printed circuit board located beneath the keypad member and fastener devices securing the circuit board to the outer housing with the keypad member sandwiched between the circuit board and outer housing, and a sealing mechanism between the keypad member and inner surface of the control panel extending around the entire periphery of the keypad area to prevent moisture from entering the space between the keypad member and circuit board.

Preferably, the sealing mechanism comprises a tongue and groove arrangement, with the keypad member having an upwardly facing groove extending around the peripheral rim area and the control panel having a corresponding, downwardly projecting rib extending around the periphery of the keypad area and aligned with the peripheral groove for engagement in the groove when the circuit board is secured to the housing. The rib has a height greater than the depth of the groove such that it will compress the material of the keypad to form a moisture-tight seal. Alternatively, the keypad member may have an upwardly projecting rib extending around the peripheral rim area for engagement in a corresponding groove in the control panel.

Since the keypad member is an imperforate sheet of flexible material with no openings in the area inside the sealing groove, any moisture entering the keyboard unit through the key openings will be trapped in the region above the keypad member. Thus, the circuit board is protected against damage as a result of liquid spills or the like. This is particularly useful for a keyboard unit designed for use with a mobile computer system in a vehicle such as a truck, car, train or the like, where spills are often more likely to occur. It is becoming quite common for vehicles to be installed with mobile communications and computer units for tracking purposes, and the sealed keyboard unit of this invention is particularly suitable for use with such units.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
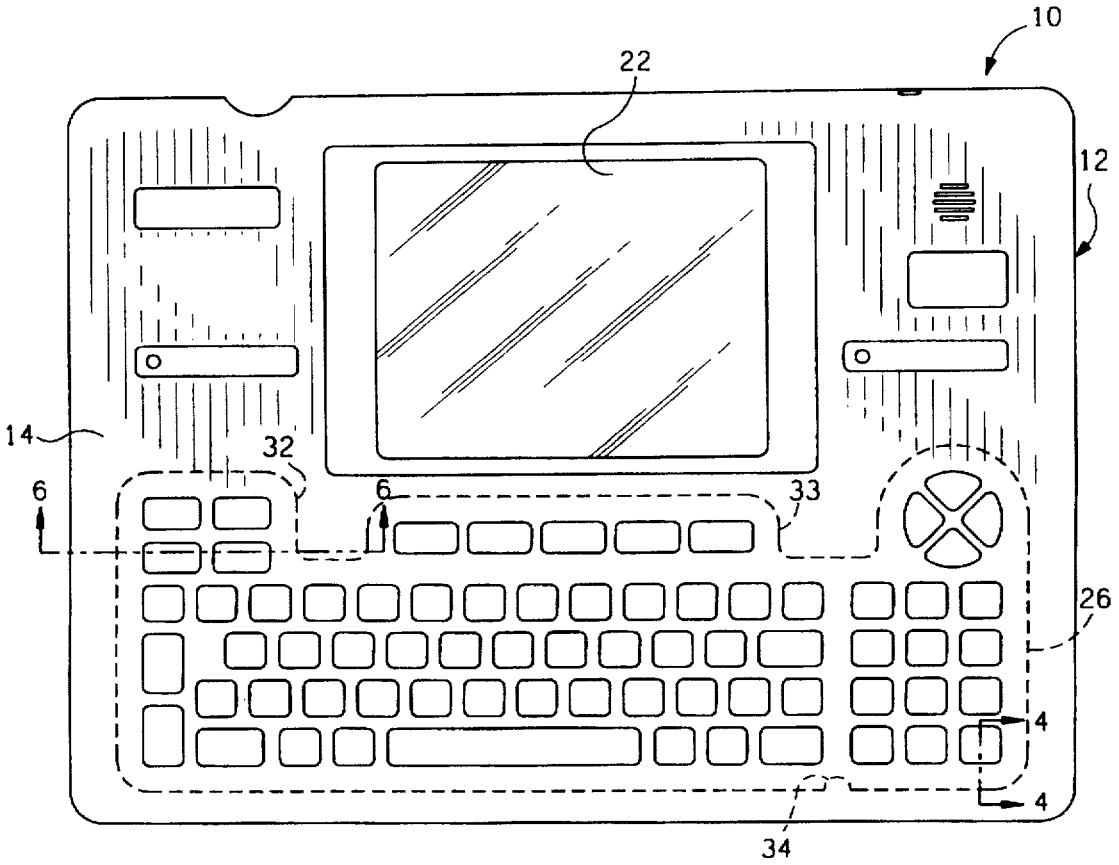
FIG. 1 is a top plan view of a keyboard unit incorporating a keypad moisture seal according to a preferred embodiment of the present invention.
Figure 2:
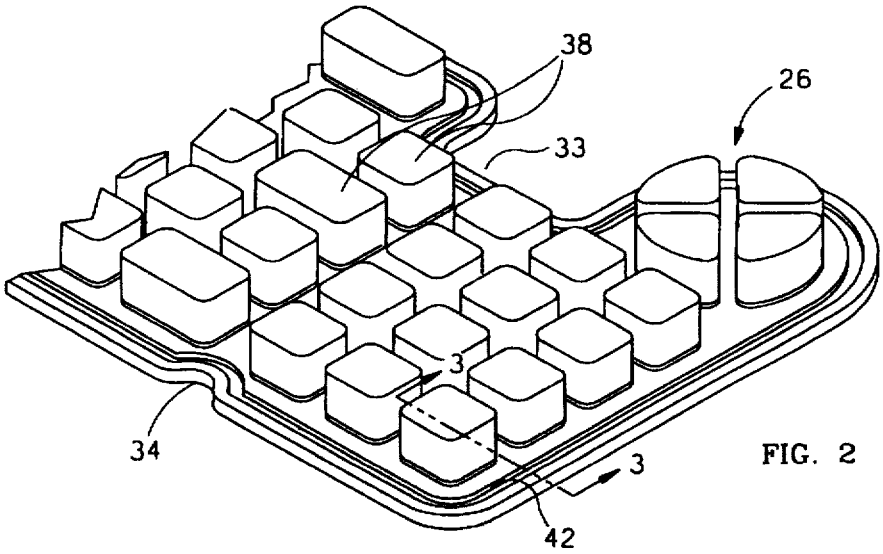
FIG. 2 is a partial perspective view of a portion of the keypad.

FIG. 1 illustrates a keyboard unit 10 containing a keypad 26 with a moisture seal according to a preferred embodiment of the invention, which is illustrated in detail in FIGS. 2–6. Keyboard unit 10 basically comprises an outer housing 12 of rigid plastic material or the like having an upper control panel 14 and a downwardly depending rim 16, and a base plate 18 secured to the rim to form an internal chamber 20. The upper control panel has a relatively large opening in which a video display screen 22 is mounted, and a plurality of openings 24 in a keypad area extending across the control panel beneath the display screen.

Figure 4:
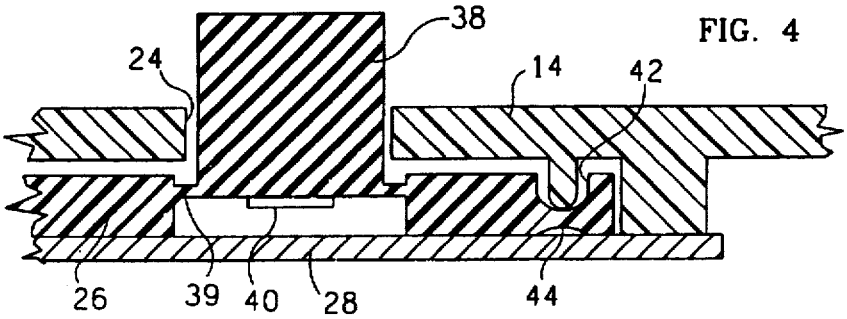
FIG. 4 is a section on the lines 4—4 of FIG. 1.
Figure 5:
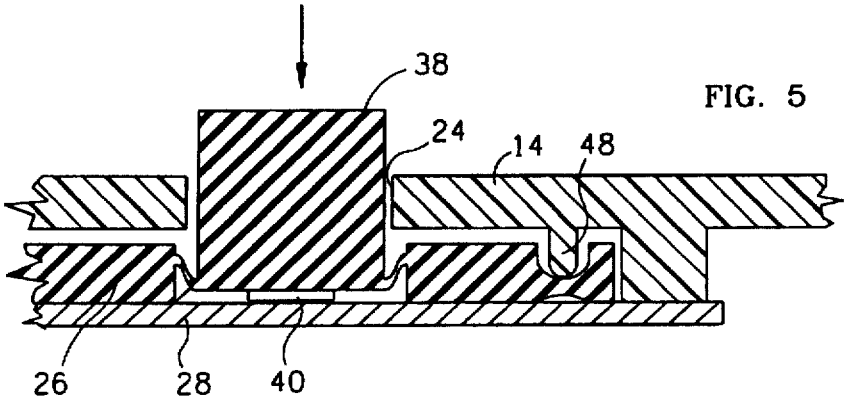
FIG. 5 is a view similar to FIG. 4, illustrating depression of a key to actuate an underlying switch.
Figure 6:
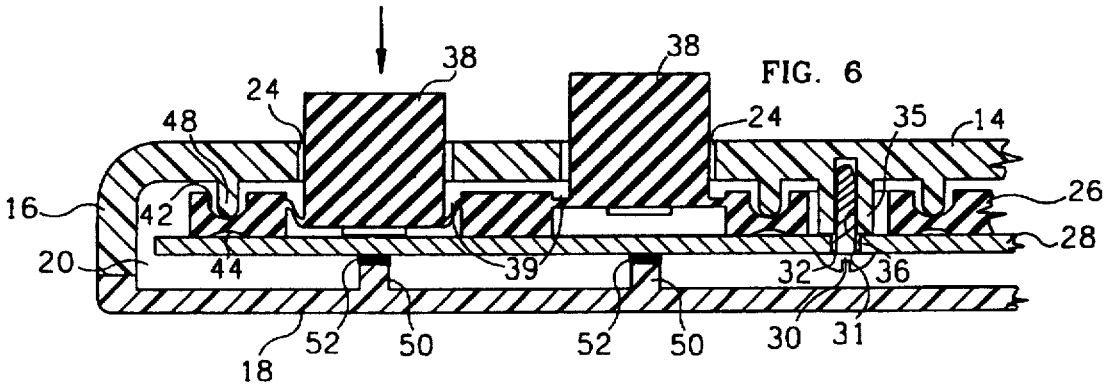
FIG. 6 is a section on the lines 6—6 of FIG. 1.

A keypad 26 comprising a one-piece, imperforate member of flexible plastic or silicone rubber material is mounted in the chamber 20 beneath the keypad area of the panel. A rigid printed wiring board or circuit board 28 of a type conventionally used in keyboard units is mounted beneath the keypad 26 and is secured to the control panel by suitable fastener devices such as screws 30 extending through openings 31 in the circuit board and aligned cut outs or recesses 32,33 and 34, respectively, in the perimeter of the keypad 26. Thus, the keypad is sandwiched between the control panel and circuit board 28 as illustrated in FIGS. 4–6. As best illustrated in FIG. 6, a boss 35 projects downwardly from the lower surface of panel 14 through each recess 32,33,34 and aligned opening 31. Boss 35 has a threaded bore 36 for threaded engagement with the respective screw. Preferably, three fastener screws 30 are used to secure the circuit board to the control panel although a greater or lesser number may be used if desired, for example for larger or smaller keypads. Alternatively, some other type of fastener device may be provided, such as a snap engagement between the circuit board and control panel.

The keypad 26 comprises a continuous, imperforate sheet of a suitable flexible material such as silicone rubber or plastic, with a plurality of integral, upwardly projecting keys or blocks 38 each aligned with a respective one of the openings 24 in the control panel so as to project upwardly through the opening, as illustrated in FIGS. 4 and 5. In an alternative arrangement, the control panel may have a single opening around the perimeter of the keypad, through which all of the keys project.

Each block 38 is surrounded by a peripheral groove defining a web 39 of reduced thickness, allowing the block to be depressed downwardly when pressure is applied to the top of the block or key by an operator's finger, as illustrated in FIG. 5. When pressure is released, the flexed web region 39 will bias the key back upwardly into the raised position of FIG. 4. Each key is aligned with an appropriate switch or switches on the circuit board, and has one or more contacts 40 secured to its lower face, so that the appropriate switches are closed when the key is depressed, causing the computer to perform the appropriate function.

Figure 3:
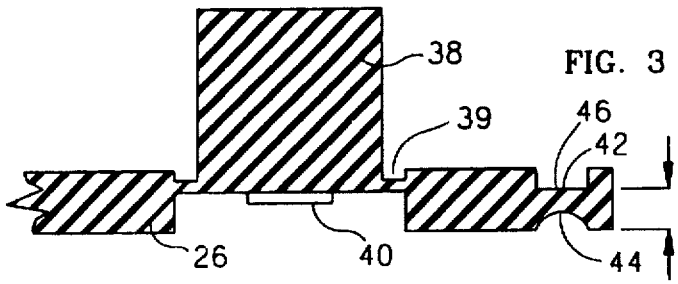
FIG. 3 is a section on the lines 3—3 of FIG. 2.

An upwardly facing groove or channel 42 extends around the periphery of the keypad 26, surrounding the keypad containing area. A corresponding downwardly facing groove 44 extends around the lower surface of the keypad 26 in alignment with groove 42, forming a reduced thickness peripheral web 46. The lower surface of the panel 18 has a downwardly projecting rib 48 extending around the keypad area in alignment with groove 42, so that the rib projects into the groove as illustrated in FIGS. 4 and 5. The opposing grooves 42 and 44 in the keypad 26 are illustrated in their uncompressed state in FIG. 3. When the keypad is installed in the housing 12 and the circuit board is secured to the upper panel 14 of the housing by tightening screws 30, the rib 48 will compress the web 46 as illustrated in FIGS. 4 and 5, forming a moisture tight seal. Preferably, the dimensions of the groove and rib are such that a compression of the order of 0.004 to 0.026 inches is produced when the circuit board is secured to the control panel. However, these dimensions may be varied depending on the durometer or hardness of the keypad material. The downwardly facing groove 44 allows more flexing and compression of the keypad material, producing a better seal. The upwardly facing groove is of generally rectangular cross-section in its uncompressed state, as best illustrated in FIG. 3, while the downwardly facing groove 44 is rounded or arcuate in shape. As illustrated in FIG. 3 and 4, the downwardly facing groove becomes wider and more flattened as the rib 48 is urged downwardly by tightening fastener screws 30. Alternative tongue and groove shapes may be used to provide the seal in alternative configurations of the invention. For example, both the tongue and groove mating surfaces may be arcuate.

Preferably, a series of spaced posts 50 project upwardly from base plate 18 to contact the undersurface of circuit board 28. Each post has a pad 52 of compliant material at its upper end. This serves to provide more even pressure below the keypad and a better seal around the perimeter.

Instead of providing a groove in the keypad 26, the keypad may have an upwardly projecting rib which engages a corresponding groove in the lower face of the control panel 14. The rib will then be compressed to form a seal as the control panel and circuit board are urged towards one another by tightening the screws 30. In the preferred embodiment, as illustrated, the entire keypad is of flexible material such as silicone rubber or flexible plastic. However, a similar moisture seal may alternatively be provided around the periphery of a keypad having a silicone rubber base and rigid keys mounted on the rubber base. Alternatively, a keypad may be provided with a groove of silicone rubber or flexible material around the perimeter.

The keypad moisture seal will effectively seal the portions of the chamber 20 outside the seal between rib 48 and groove 42 and beneath keypad 26 from liquid which may enter the region above keypad 26 via key openings 24. Since the keypad itself has no openings in the region inside the channel or groove 42, and all the fastener screws 30 are located outside the perimeter of the keypad, any moisture entering via openings 24 will be trapped in the sealed region above the keypad and within the perimeter of the seal formed between the rib 48 and groove 42.

The moisture seal at the perimeter of the keypad permits moisture sensitive portions of the system to be protected against damage as a result of accidental spills. Such spills are quite common where keyboard units are installed as control panels in vehicles such as trucks or the like. The recessed area around the perimeter of the keypad provides a compliant, compressible trough for the housing rib to seat in and seal against liquid. The sealing mechanism is simple and inexpensive to manufacture, and provides good protection against leakage of liquid into the interior chamber of a keyboard housing.

Although a preferred embodiment of the invention has been described above by way of example only, it will be understood by those skilled in the field that modifications may be made to the disclosed embodiment without departing from the scope of the invention, which is defined by the appended claims.

We claim:

1. A keypad assembly, comprising:

an outer housing having an upper panel and an internal keypad receiving area, the upper panel having a key area having at least one opening, an outer face, and an inner face;

a keypad of flexible material positioned in said keypad receiving area beneath said upper panel, said keypad comprising an upwardly facing groove extending around a keypad peripheral rim and a downwardly facing groove in alignment with said upwardly facing groove;

a printed wiring board positioned in said keypad receiving area below said keypad;

fastener means for securing the printed wiring board to the outer housing with the keypad sandwiched between the upper panel of the housing and the wiring board; and a downwardly facing rib extending around the inner surface of the upper panel of the housing in alignment with said upwardly facing groove;

whereby the material between said upwardly facing groove and said downwardly facing groove is compressed by said downwardly facing rib when said wiring board is secured to said housing so as to form a seal against moisture entering the space between the keypad and wiring board.

2. The assembly of claim 1, wherein said upwardly facing groove is of generally rectangular cross section and said downwardly facing groove is generally arcuate shape when not under compression.

3. The assembly of claim 1 wherein said keypad comprises a rib extending around said keypad peripheral rim for engaging a downwardly facing groove located around the inner face of the upper panel of the housing in alignment with said rib, said downwardly facing groove further comprising an upwardly facing groove in alignment with said downwardly facing groove.

* * * * *